United States Patent [19]

Adair

[11] 4,303,270

[45] Dec. 1, 1981

[54] SELF-CENTERING CLAMP

[75] Inventor: Harold L. Adair, Rockwall, Tex.

[73] Assignee: Walker-Neer Manufacturing Co., Inc., Wichita Falls, Tex.

[21] Appl. No.: 74,547

[22] Filed: Sep. 11, 1979

[51] Int. Cl.[3] ..... B66C 1/42

[52] U.S. Cl. ..... 294/88; 414/22

[58] Field of Search ..... 294/88, 106, 110 R, 294/115, 119, 83 R, 83 A, 104, 100; 269/31; 414/22; 175/52, 85, 161

[56] References Cited

U.S. PATENT DOCUMENTS

| | | | |
|---|---|---|---|
| 3,386,726 | 6/1968 | Lorenz | 269/31 |
| 3,881,761 | 5/1975 | Meyer et al. | 294/88 |
| 4,172,684 | 10/1979 | Jenkins | 414/22 |

*Primary Examiner*—James B. Marbert

*Attorney, Agent, or Firm*—Hume, Clement, Brinks, William & Olds, Ltd.

[57] ABSTRACT

A self centering clamp for down-hole tubulars includes first and second opposed clamping members guided along a clamping axis by first and second guide channels defined by a frame. Each clamping member defines a hydraulic cylinder in which is disposed a piston which is rigidly mounted to the frame. A rack is coupled to move with each of the clamping members. These racks are interconnected via a pinion gear which meshes with both racks so that the two clamping members move in a counterdirectional manner and remain equidistant from a central point on the clamping axis. In this way the clamp centers down-hole tubulars of various diameters about the same line, perpendicular to the clamping axis.

10 Claims, 4 Drawing Figures

1a.
1b.
10
12
14
16
20
24
26
28
30

SELF-CENTERING CLAMP

BACKGROUND OF THE INVENTION

The present invention relates to a device for clamping oil well and water well tubulars and rods, including but not limited to drill pipe, drill collars, well casing, production tubing, sucker rods, pump column pipe, and the like, all of which tubulars, pipes and rods are referred to herein simply as "down-hole tubulars." More particularly, this invention relates to such a clamp which precisely centers down-hole tubulars of varying diameters.

In well drilling and well completion operations it is often necessary to lift and precisely align lengths of down-hole tubulars. For example, in oil or water well drilling, multiple lengths of drill pipe must often be raised from a horizontal position at or near ground level to a vertical position aligned with the centerline of the well. Such lifting and aligning operations require some type of a clamp for securely holding the pipe in place as it is lifted. When a pivotably mounted pipe boom is used, this clamp must support large loads in several different orientations.

Compounding the problem is the fact that each joint or length of down-hole tubular must be closely aligned with a string of such tubulars after it has been lifted to the vertical position, as when a string of drill pipe or casing is being made up, for example. A clamp for such purposes should preferably provide, without any adjustment, the necessary alignment for down-hole tubulars having various diameters. Proper alignment has been a problem for many such clamps of the prior art, especially those employing pivoted clamping jaws.

When pivoted clamping jaws are used, there is a tendency for the center of the clamped down-hole tubular to vary as a function of the diameter of the tubular being clamped. This problem may be alleviated somewhat by using guided jaws in conjunction with symmetrically moving pivoted rocker arms. Such an arrangement is shown in a machine tool clamp described by Lorenz in U.S. Pat. No. 3,386,726. In the Lorentz clamp the guided jaws are free to translate with respect to the pivotably mounted rocker arms as the clamp closes.

This approach, however, suffers from the disadvantage that loads are not symmetrically distributed in the clamp for the full range of clamp positions. As the guided jaw translates with respect to the rocker arm, the center of clamping force on the jaw moves.

SUMMARY OF THE INVENTION

The present invention is directed to a self-centering clamp for down-hole tubulars which avoids these and other disadvantages of the prior art.

The general object of this invention is to provide a clamp for down-hole tubulars which precisely clamps and centers such tubulars in such a manner that in each case the tubular is clamped with its central axis at a substantially constant position with respect to the clamp, in spite of variations in the diameter of the clamped tubular.

Another object of this invention is to provide a sturdy clamp which symmetrically bears the clamping forces associated with clamping and holding down-hole tubulars having a range of diameters.

Yet another object of this invention is to provide a clamp having the aforementioned self-centering and symmetrical load bearing features which can clamp down-hole tubulars having a predetermined range of diameters without requiring manual adjustment or replacement of component parts, thereby speeding and facilitating both drilling and well service operations.

Yet another object of this invention is to provide a clamp having the aforementioned self-centering and symmetrical load bearing features which is compact and avoids complex positioning linkages.

Yet another object of this invention is to provide a clamp which can be rotatably mounted to a pipe boom, thereby facilitating gravity loading and unloading of the clamp, as well as the use of automated or semi-automated loading and unloading systems.

According to this invention, these and other objects are achieved by providing a clamp having two opposed clamping members which are guided along a clamping axis. Hydraulically operated means are provided for positioning the clamping members along the clamping axis, and the clamping members are centered along the clamping axis by centering means which ensures that both clamping members remain substantially equidistant from a predetermined point on the clamping axis as they are moved along the clamping axis by the positioning means.

In a preferred embodiment, the centering means includes a pair of racks, one mounted to each clamping member, and a pinion gear which is meshingly engaged with both racks. This preferred embodiment also includes a compact hydraulic cylinder arrangement in which each clamping member defines a cylinder in which is disposed a piston. Both pistons are mounted to a frame such that the clamping members move along the clamping axis when hydraulic fluid is forced into the cylinders.

In that both clamping members are guided along the clamping axis, the clamp of this invention provides substantially symmetrical load bearing capability for a wide range of down-hole tubular diameters. This facilitates the design of a clamp which is sturdy yet not unduly heavy due to the need to withstand assymmetrical clamping loads.

Another advantage of this invention is that down-hole tubulars of varying diameters can be accurately clamped and centered about the same clamping axis. This facilitates precise alignment of the clamped length of down-hole tubular with other such lengths, such as in a drill string or a production string, for example.

Another advantage of this invention is that the clamp is relatively compact and does not employ complex rocker arm linkages.

The clamp of this invention provides the further advantages that no manual adjustment or replacement of parts is required to obtain the precise centering and symmetrical clamping features described above, even when down-hole tubulars of varying diameters are clamped.

These and other objects and attendant advantages of the present invention will be better understood by reference to the following description taken in connection with the appended drawings.

DETAILED DESCRIPTION OF A PREFERRED EMBODIMENT

Figures 1, 1A, 1B:
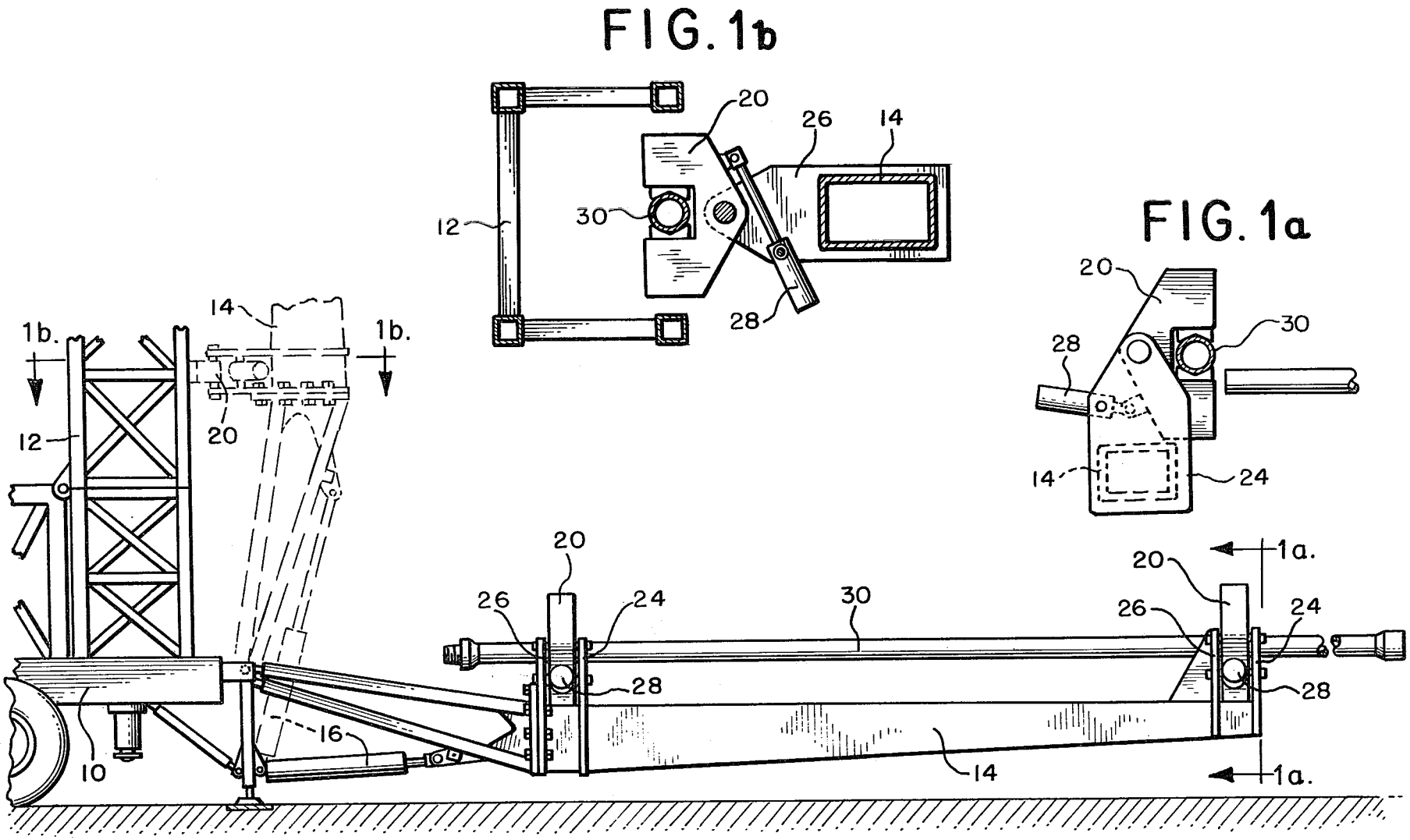
FIG. 1 is an elevational view of a drill rig including a pipe boom on which is mounted a preferred embodiment of the clamp of this invention.
FIG. 1*a* is an end view taken along line 1*a*—1*a* of FIG. 1 showing the clamp rotated to the loading position.
FIG. 1*b* is a cross-sectional view taken along line 1*b*—1*b* of FIG. 1 showing the clamp rotated to align the clamped down-hole tubular with the drill string.

Referring now to the drawings, FIG. 1 shows the rear end of a mobile drill rig 10 which includes a vertical tower 12, and a pipe boom 14, pivotably connected to the rig 10. Hydraulic cylinders 16 position the boom 14 between the horizontal position, shown in solid lines, and the vertical position, in which the boom 14 is substantially parallel to the tower 12.

The boom 14 is provided with two hydraulically operated clamps 20 for clamping and holding down-hole tubulars as they are transported between the horizontal and vertical positions. Each clamp 20 is pivotably mounted between spaced, parallel plates 24,26 which are securely mounted to the boom 14. A double-acting hydraulic cylinder 28 is trunion mounted on the plate 24 to pivot the clamp 20 as necessary.

FIG. 1*a* shows the clamp 20 rotated to the side to permit down-hole tubulars such as length of drill pipe 30 to be loaded into and unloaded from the clamp 20 from the side. This facilitates loading and unloading operations and permits the boom 14 to be used with automatic and semi-automatic pipe handling equipment on the ground.

FIG. 1*b* shows the boom 14 in the vertical position, adjacent the tower 12, with the clamp 20 rotated to align the clamped drill pipe 30 with the drill string. As can be seen from FIG. 1*b*, the clamp 20 has been rotated by about 90° as compared with FIG. 1*a* to bring the clamped drill pipe 30 into the plane of the drill string.

Figure 2:
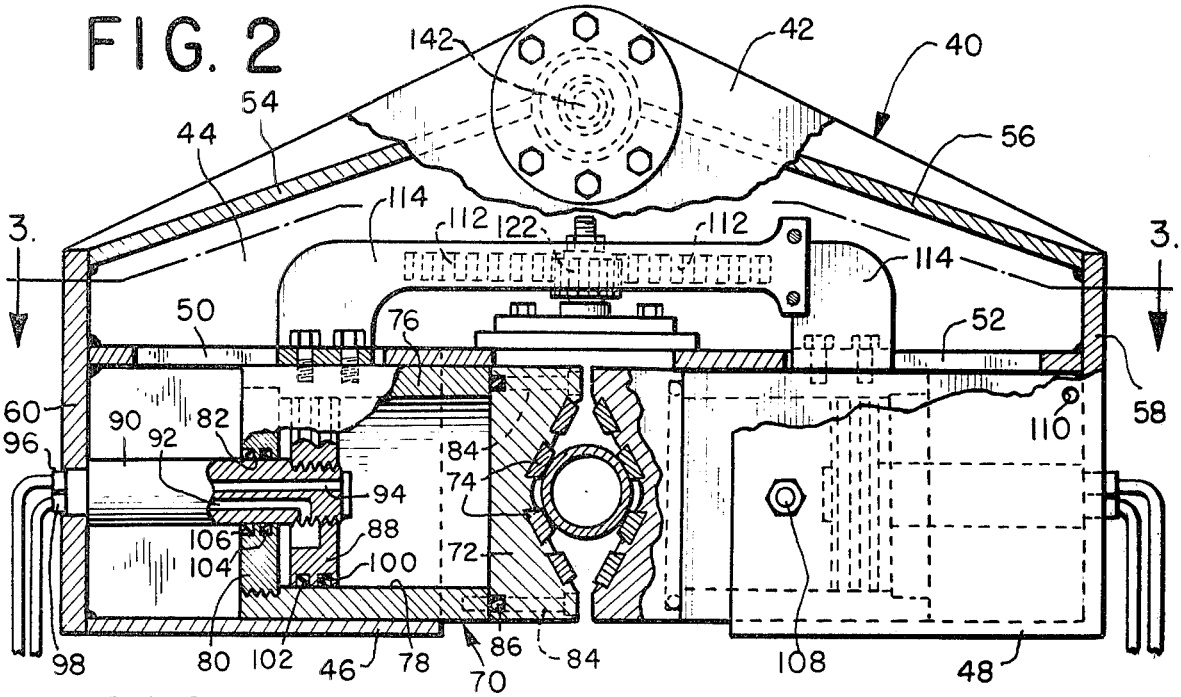
FIG. 2 shows a cross-sectional view of the clamp of FIG. 1 perpendicular to the axis of rotation of the clamp.
Figure 3:
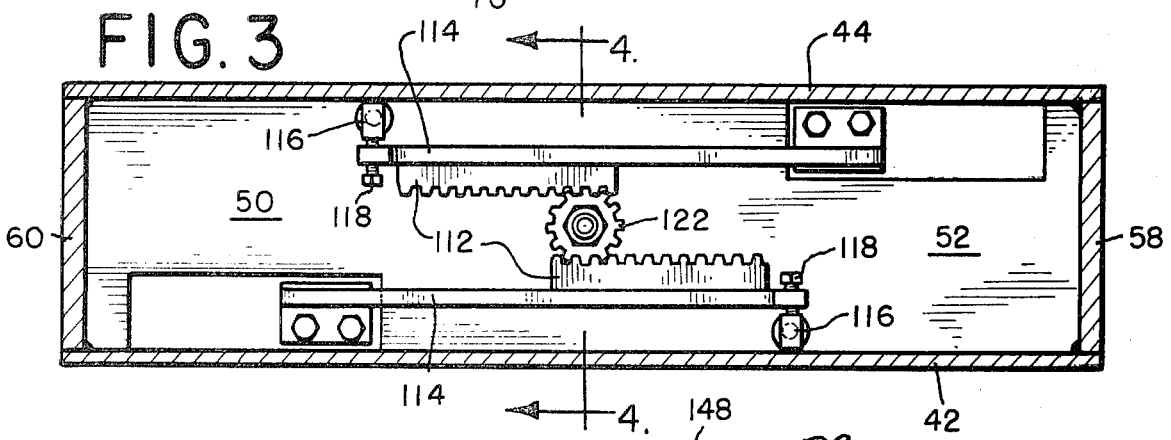
FIG. 3 shows a sectional view taken along line 3—3 of FIG. 2.
Figure 4:
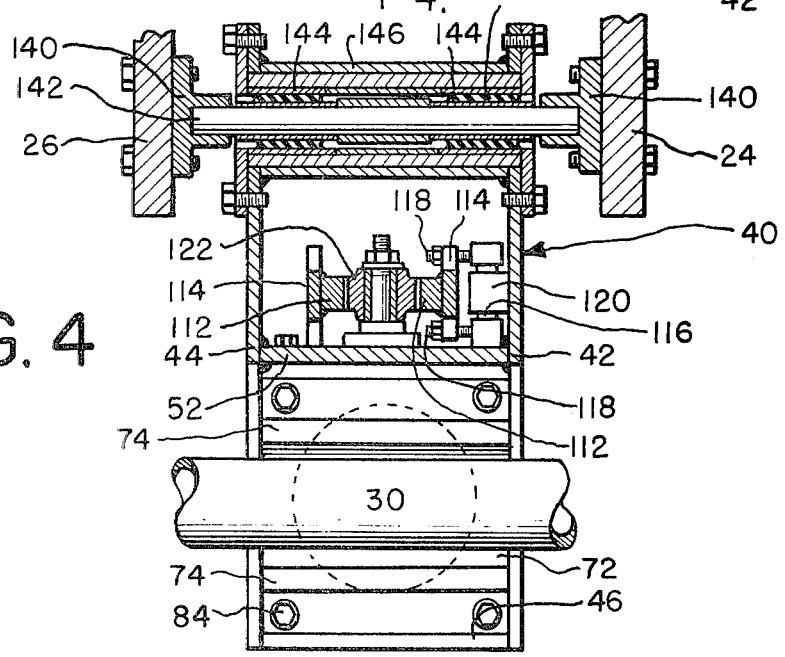
FIG. 4 shows a sectional view taken along line 4—4 of FIG. 3.

FIGS. 2, 3 and 4 present detailed views of the clamp 20. Referring to FIGS. 2 and 4, the clamp 20 is surrounded by a frame 40 which is built up from steel plates. This frame 40 includes spaced, parallel plates 42,44. Transverse plates 46,48,50,52,54,56,58 and 60 extend between and are welded to both the parallel plates 42,44 to form a rigid frame. Plates 42,44,46,50 form a first guide channel having a square cross-section measuring about 8 inches by 8 inches. Plates 42,44,48,52 form a second guide channel having a square cross-sectional measuring about 8 inches by 8 inches. These two guide channels are aligned co-linearly along a clamp axis.

A clamping member 70 is slideably mounted in each guide channel. Each clamping member includes a clamping face 72 in which four hardened steel gripping members 74 are mounted in dovetailed grooves. These gripping members actually contact and grip the down-hole tubular being clamped. Each clamping member also includes a center section 76 which defines a cylindrical bore 78 having a diameter of about six inches. An end plate 80 defines a central bore 82. The center section 76 and the clamping face 72 are held together to form a single unit by four bolts 84, one in each corner of the clamping member, and the end plate 80 is secured to the center section 76 by threads. An O-ring seal 86 is provided between the center section 76 and the face 72. When assembled, the three components 72,76,80 form a central cavity which defines a hydraulic cylinder.

A piston 88 is disposed inside the cylinder. The piston 88 is threaded to a piston rod 90, which is in turn threaded to a plate 58,60 of the frame 40, so that the piston 88 is rigidly secured to the frame 40. The piston rod 90 defines two passageways 94,92. Passageway 92 connects hydraulic fitting 98 with the rear face of the piston 88, and passageway 94 connects hydraulic fitting 96 with the front face of the piston 88. Applying pressurized hydraulic fluid to fitting 98 causes the clamping members 70 to move apart, while applying pressurized hydraulic fluid to fitting 96 causes the clamping members 70 to move towards each other. The piston 88 is provided with a pair of cup sealing rings 100,102, and the end plate 80 is provided with a cup sealing ring 104 and a piston rod scraping ring 106.

The clamping member 70 is sized about one-sixteenth of an inch narrower than the guide channels in each dimension transverse to the clamping axis. This volume is partly filled with heavy grease introduced through the fittings 108. Drain hole 110 allows water to drain from the lower guide channel.

Referring to FIGS. 2 and 3, the two clamping members are linked by a rack and pinion arrangement which includes a rack 112 rigidly coupled to each clamping member 70 via an arm 114 which passes through an opening in the transverse plate 50 or 52 and is bolted to the clamping member 70. Each arm 114 includes a roller assembly 116 which is adjustably mounted to the end of the arm 114 by two bolts 118. The roller assembly includes a cylindrical roller 120 which rolls along one of the parallel plates 42,44 to provide support to the arm 114 and maintain it parallel to the plates 42,44 and to the clamping axis.

A pinion gear 122 is rotatably mounted between the plates 50,52 to mesh with the two parallel racks 114. This pinion gear interconnects with two racks 114 and ensures that they move in a counterdirectional manner. In this way the movement of the two clamping members 70 is made symmetrical such that they remain equidistant from a predetermined point on the clamping axis as they move along the clamping axis.

As best seen in FIG. 4, the frame 40 is mounted between the plates 24,26 via spacers 140 bolted to the inside surfaces of the plates 24,26. These spacers 140 capture a pin 142 which extends through the frame 40. A pair of resilient axle mounts 144 interconnect the pin 142 and a sleeve 146 which is rigidly mounted to the frame 40. Each axle mount 144 includes a resilient elastomer sleeve 148, which allows a limited degree of rotational and translatory movement between the clamp 20 and the boom 14. In this preferred embodiment, the axle mount 144 is manufactured by Lord Kinematics and is identified as part number H-9004.

This resilient mounting allows the clamp 20 to shift as necessary to clamp tubulars which are out of round or not perfectly straight with reduced bending and nicking of the tubular, and reduced wear on the clamp.

This preferred embodiment automatically clamps and precisely centers down-hole tubulars having diameters between $2\frac{7}{8}$ inches and $8\frac{5}{8}$ inches, all without manual adjustment. This clamp is proportioned to firmly clamp and hold drill collars weighing as much as 4,000 pounds as they are accelerated and rotated by the pipe boom. Of course, the clamp of this invention could easily be modified to accept tubulars in other size ranges.

From the foregoing it should be apparent that the clamp of this invention is well suited for accurately clamping down-hole tubulars having a wide range of diameters. In each case, the clamped pipe is accurately positioned without adjustment, and the clamping loads are symmetrically borne by the clamp. The clamp is sturdy and capable of bearing the weight of a heavy drill collar in the various orientation encountered in raising and lowering the boom. The clamp is also compact, and it provides a direct means for applying clamping forces without complex linkages.

Of course, it should be understood that various changes and modifications to the preferred embodiment described herein will be apparent to those skilled in the art. For example, the size of the clamp may be varied to fit the intended application, and the clamp may be mounted nonrotatably onto the pipe boom if desired. Alternately, other rotating means, such as rack and pinion arrangement, can be used to rotatably position the clamp on the boom. Such changes and modifications can be made without departing from the spirit and scope of the present invention, and without diminishing its attendant advantages. It is, therefore, intended that such changes and modifications be covered by the following claims.

I claim:

1. A self-centering clamp for clamping down-hole tubulars of various diameters, said clamp comprising:

first and second opposed clamping members;

means for guiding the first and second clamping members along a rectilinear clamping axis;

first hydraulically operated means for positioning the first clamping member along the axis, said first positioning means including a first hydraulic cylinder positioned to apply a first clamping force symmetrically to the first clamping member throughout the travel of the first clamping member;

second hydraulically operated means, opposed to the first positioning means, for positioning the second clamping member along the axis, said second positioning means including a second hydraulic cylinder positioned to apply a second clamping force symmetrically to the second clamping member throughout the travel of the second clamping member;

means for centering the first and second clamping members about a predetermined point on the clamping axis such that both clamping members remain substantially equidistant from the predetermined point as they are moved along the clamping axis by the first and second positioning means, respectively, and a down-hole tubular clamped between the first and second clamping members is centered at a predetermined position with respect to the guiding means;

said centering means comprising a first rack mounted to the first clamping member, a second rack mounted to the second clamping member, and a pinion gear rotatably mounted to mesh with both the first and second racks such that movement of the first clamping member along the clamping axis causes the pinion gear to rotate, which in turn causes the second clamping member to move along the clamping axis, symmetrically with respect to the first clamping member.

2. A self-centering clamp for clamping down-hole tubulars of various diameters, said clamp comprising:

first and second opposed clamping members;

means for guiding the first and second clamping members along a clamping axis;

first hydraulically operated means for positioning the first clamping member along the axis;

second hydraulically operated means opposed to the first positioning means for positioning the second clamping member along the axis;

a pinion gear rotatably mounted to the guide means;

a first rack mounted to the first clamping member to engage the pinion gear such that movement of the first clamping member along the clamping axis causes rotation of the pinion gear; and a second rack mounted to the second clamping member to engage the pinion gear such that movement of the second clamping member along the clamping axis causes rotation of the pinion gear, and the first and second clamping members are thereby maintained substantially equidistant from a predetermined point on the clamping axis as the first and second clamping members move along the clamping axis such that a down-hole tubular clamped between the first and second clamping members is centered at a predetermined position with respect to the guiding means.

3. A self-centering clamp for clamping down-hole tubulars of various diameters, said clamp comprising:

first and second opposed clamping members, each clamping member defining a cavity which forms a hydraulic cylinder;

means for guiding the first and second clamping members along a rectilinear clamping axis;

first and second pistons disposed inside the cylinders defined by the first and second clamping members, respectively, and mounted to the guiding means;

means for introducing hydraulic fluid into the cylinders defined by the first and second clamping members to apply clamping forces symmetrically to the first and second clamping members throughout the travel of the first and second clamping members and thereby to cause the first and second clamping members to move along the clamping axis; and means for centering the first and second clamping members about a predetermined point on the clamping axis such that both clamping members remain substantially equidistant from the predetermined point as they are moved along the clamping axis by the first and second positioning means, respectively, and a down-hole tubular clamped between the first and second clamping members is centered at a predetermined position with respect to the guiding means;

said centering means comprising a first rack mounted to the first clamping member, a second rack mounted to the second clamping member, and a pinion gear rotatably mounted to mesh with both the first and second racks such that movement of the first clamping member along the clamping axis causes the pinion gear to rotate, which in turn causes the second clamping member to move along the clamping axis, symmetrically with respect to the first clamping member.

4. The clamp of claim 1 or 3 further including means for resiliently mounting the guiding means to a pipe boom such that the guiding means can move laterally and rotationally with respect to the pipe boom.

5. The clamp of claim 2 wherein the first and second clamping members define first and second chambers, respectively, each of which chambers forms a hydraulic cylinder and, further, wherein each positioning means includes a piston secured to the guiding means and disposed to slide within the respective chamber, and means for selectively introducing hydraulic fluid into the respective chambers.

6. The clamp of claim 1 wherein the first hydraulic cylinder comprises a first chamber defined in the first clamping member and a first piston secured to the guiding means and disposed sealingly to slide within the first chamber; and further, wherein the second hydraulic cylinder comprises a second chamber defined in the second clamping member and a second piston secured to the guiding means and disposed sealingly to slide within the second chamber.

7. A self-centering clamp for clamping down-hole tubulars of various diameters, said clamp comprising:

a frame defining first and second opposed, colinear guide channels, aligned along a clamping axis;

first and second clamping members slideably disposed within the first and second guide channels, respectively, said first and second clamping members defining first and second cylindrical cavities aligned with the clamping axis, respectively;

first and second piston rods mounted to the frame and aligned with the clamping axis to extend into the first and second cylindrical cavities, respectively;

first and second pistons mounted to the first and second piston rods within the first and second cavities, respectively, such that movement of the first and second clamping members along the clamping axis causes the first and second pistons to move within the first and second cylinders, respectively;

a pinion gear rotatably mounted to the frame;

a first rack mounted to the first clamping member to engage the pinion gear;

a second rack mounted to the second clamping member to engage the pinion gear such that the first and second racks and the pinion gear cooperate to maintain the first and second clamping members substantially equidistant from a central point on the clamping axis as the first and second clamping members move within the first and second guide channels, respectively; and means for selectively conducting hydraulic fluid into the first and second cavities to position the first and second clamping members, respectively, along the clamping axis.

8. The clamp of claim 7 wherein the conducting means includes a conduit formed in each piston rod, through which hydraulic fluid is passed into the respective cavity.

9. The clamp of claim 7 wherein the conducting means includes first and second conduits formed in the first piston rod to conduct hydraulic fluid to a first and second side of the first piston, respectively, and third and fourth conduits formed in the second piston rod to conduct hydraulic fluid to a first and second side of the second piston, respectively.

10. The clamp of claim 7 further including means for resiliently mounting the frame to a pipe boom to permit limited translatory and rotational movement of the frame with respect to the pipe boom.

* * * * *